US008109112B2

(12) United States Patent
Smith et al.

(10) Patent No.: US 8,109,112 B2
(45) Date of Patent: Feb. 7, 2012

(54) VARIABLE ICE STORAGE ASSEMBLY AND METHOD OF USE

(75) Inventors: Lindsey A. Smith, Saint Joseph, MI (US); Timothy A. Fulton, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 1002 days.

(21) Appl. No.: 12/036,347

(22) Filed: Feb. 25, 2008

(65) Prior Publication Data

US 2009/0211292 A1 Aug. 27, 2009

(51) Int. Cl.
*F25C 5/18* (2006.01)

(52) U.S. Cl. ..... 62/344

(58) Field of Classification Search ..... 62/344, 62/440, 459; 312/404; 340/540
See application file for complete search history.

(56) References Cited

U.S. PATENT DOCUMENTS

| | | | | |
|---|---|---|---|---|
| 2,717,505 | A | 9/1955 | Anderson | |
| 3,436,928 | A | 4/1969 | Swerbinsky | |
| 3,892,105 | A | 7/1975 | Bernard | |
| 4,100,761 | A * | 7/1978 | Linstromberg et al. | 62/137 |
| 4,649,717 | A | 3/1987 | Tate, Jr. et al. | |
| 4,719,762 | A | 1/1988 | Osabe | |
| 4,835,978 | A | 6/1989 | Cole | |
| 4,942,979 | A | 7/1990 | Linstromberg et al. | |
| 5,160,094 | A | 11/1992 | Willis et al. | |
| 5,350,085 | A | 9/1994 | Kidd et al. | |
| 5,619,858 | A | 4/1997 | Gunderson et al. | |
| 6,050,097 | A * | 4/2000 | Nelson et al. | 62/137 |
| 6,082,130 | A | 7/2000 | Pastryk et al. | |
| 6,148,624 | A | 11/2000 | Bishop et al. | |
| 6,314,745 | B1 | 11/2001 | Janke et al. | |
| 6,324,855 | B1 | 12/2001 | Mullis | |
| 6,405,553 | B1 | 6/2002 | Willett | |
| 6,425,259 | B2 | 7/2002 | Nelson et al. | |
| 6,438,976 | B2 | 8/2002 | Shapiro et al. | |
| 6,763,674 | B2 | 7/2004 | Siefker | |
| 6,804,974 | B1 * | 10/2004 | Voglewede et al. | 62/264 |
| 7,062,935 | B2 | 6/2006 | Siefker | |

FOREIGN PATENT DOCUMENTS

| | | |
|---|---|---|
| JP | 2000180005 | 6/2000 |
| JP | 2000180005 A | 6/2000 |
| JP | 2001153515 | 6/2001 |
| JP | 2001153515 A | 6/2001 |

* cited by examiner

*Primary Examiner* — Melvin Jones
(74) *Attorney, Agent, or Firm* — Kirk W. Goodwin; Diederiks & Whitelaw PLC

(57) ABSTRACT

A variable ice storage assembly for a refrigerator includes a storage cavity adapted to receive ice from an ice maker. The storage assembly is positioned between a light emitter and a receiver of an ice level sensor. The storage assembly can be utilized in a non-reflecting configuration wherein the ice level sensor functions in a standard manner, or a reflecting configuration wherein the sensing level is effectively lowered within the storage assembly. In the reflecting configuration, first and second mirrored inserts, supported by respective insert portions on the storage assembly, cooperate with first and second reflecting plates on the storage assembly to redirect light from the emitter in a circuitous path. A user may position the mirrored inserts at various angles, depending on the level of ice desired within the storage assembly. The storage assembly may be utilized alone, or as in insert within an ice bucket.

25 Claims, 5 Drawing Sheets

VARIABLE ICE STORAGE ASSEMBLY AND METHOD OF USE

BACKGROUND OF THE INVENTION

1. Field of the Invention

The present invention pertains to the art of ice making in refrigerators and, more particularly, to a variable ice storage assembly within a refrigerator, as well as its method of use.

2. Discussion of the Related Art

Automatic ice making systems for use in domestic refrigerators is well known. A typical ice making system includes an ice maker mounted within the freezer compartment of the refrigerator and an ice storage receptacle or bin supported beneath the ice maker for receiving the formed ice from the ice maker. The ice maker is commonly mounted within the freezer compartment adjacent the side or rear wall of the freezer compartment such that water and power can be readily supplied to the ice maker. The ice storage receptacle is supported by a shelf or other structure arranged beneath the ice maker within the freezer compartment. The ice storage receptacle generally extends across a significant portion of the freezer compartment and has a front end adjacent the freezer door. U.S. Pat. No. 4,942,979 to Linstromberg et al. is an example of a prior art ice making system.

It is known to prevent an ice maker assembly from sending ice cubes to a storage bin when the storage bin is not positioned to receive ice. In one proposed solution as set forth in U.S. Pat. No. 6,438,976, a bin detection sensor, such as an inductive or optical sensor, is used to sense the presence of the storage bin.

Another aspect of conventional ice making systems is that they produce a fixed quantity of ice pieces. This leads to the problem of ice staleness for consumers who have relatively low ice consumption needs. U.S. Pat. No. 4,835,978 to Cole discloses a common means used to limit the quantity of ice formed by the ice maker. In Cole, an ice quantity sensor, constituted by a sensing arm, is periodically lowered into the ice storage receptacle for sensing the amount of ice supplied into the storage receptacle. An alternative ice sensing method is set forth in U.S. Pat. No. 6,050,097 to Nelson et al., which discloses the use of an electronic optical system for sensing the presence of ice pieces within an ice bucket. However, Cole and Nelson et al. only provide single fixed level sensing systems, which results in a set volume of ice being produced and stored in an ice bucket.

To actually avoid the problem of ice staleness, it is desirable to limit the amount of ice available based on individual consumers ice consumption. U.S. Pat. Nos. 5,619,858 and 4,719,762 illustrate past efforts to provide flexibility in the amount of ice produced and supplied to an ice bin.

The present invention addresses the need for easy delivery of fresh ice remotely from the refrigerator by providing a method and apparatus for selectively limiting the amount of ice dispensed into a variable ice storage assembly.

SUMMARY OF THE INVENTION

The present invention is directed to a variable ice storage assembly for a refrigerator. The refrigerator includes an ice maker within a freezer compartment of the refrigerator, and a variable ice storage assembly including a storage cavity adapted to receive ice dispensed from the ice maker, with the amount of ice stored being selectively adjustable. In one preferred embodiment of the invention, an inductive sensor is positioned in the refrigerator to indicate the presence of the storage assembly in the freezer compartment in order to control the formation and dispensing of ice.

The storage assembly includes first and second insert portions positioned adjacent respective opposing side walls of the storage assembly. The storage assembly can be utilized in a non-reflecting configuration when the first and second insert portions remain empty, or a reflecting configuration when first and second mirrored inserts are positioned in the first and second insert portions respectively. The storage assembly is positioned between an infrared (IR) emitter located on a first inside wall of the refrigerator and a receiver positioned on an opposing inside wall of the refrigerator. When the storage assembly is in the non-reflecting configuration, an emitted IR beam travels in a direct line to the receiver of the overall IR sensor. Any interruption of the beam by ice at a particular level within the storage assembly signals the ice maker to stop ice production. When the storage assembly is in the reflecting configuration, the first and second mirrored inserts direct the IR beam in a circuitous path that effectively lowers the level of ice sensed by the IR sensor within the storage assembly. More specifically, the emitted IR beam reflects off the first mirrored insert and is directed to a first reflecting plate within the storage cavity. The first reflecting plate directs the beam across the storage cavity to a second reflecting plate which, in turn, directs the beam to the second mirrored insert, where the beam is finally reflected toward the receiver. Multiple angled slot pairs within the respective first and second insert portions allow a user to insert the first and second mirrored inserts at a variety of angles within the storage assembly. Various angles correspond to distinct ice volume levels within the storage assembly, allowing a user to selectively limit the amount of ice available based on the user's ice consumption.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
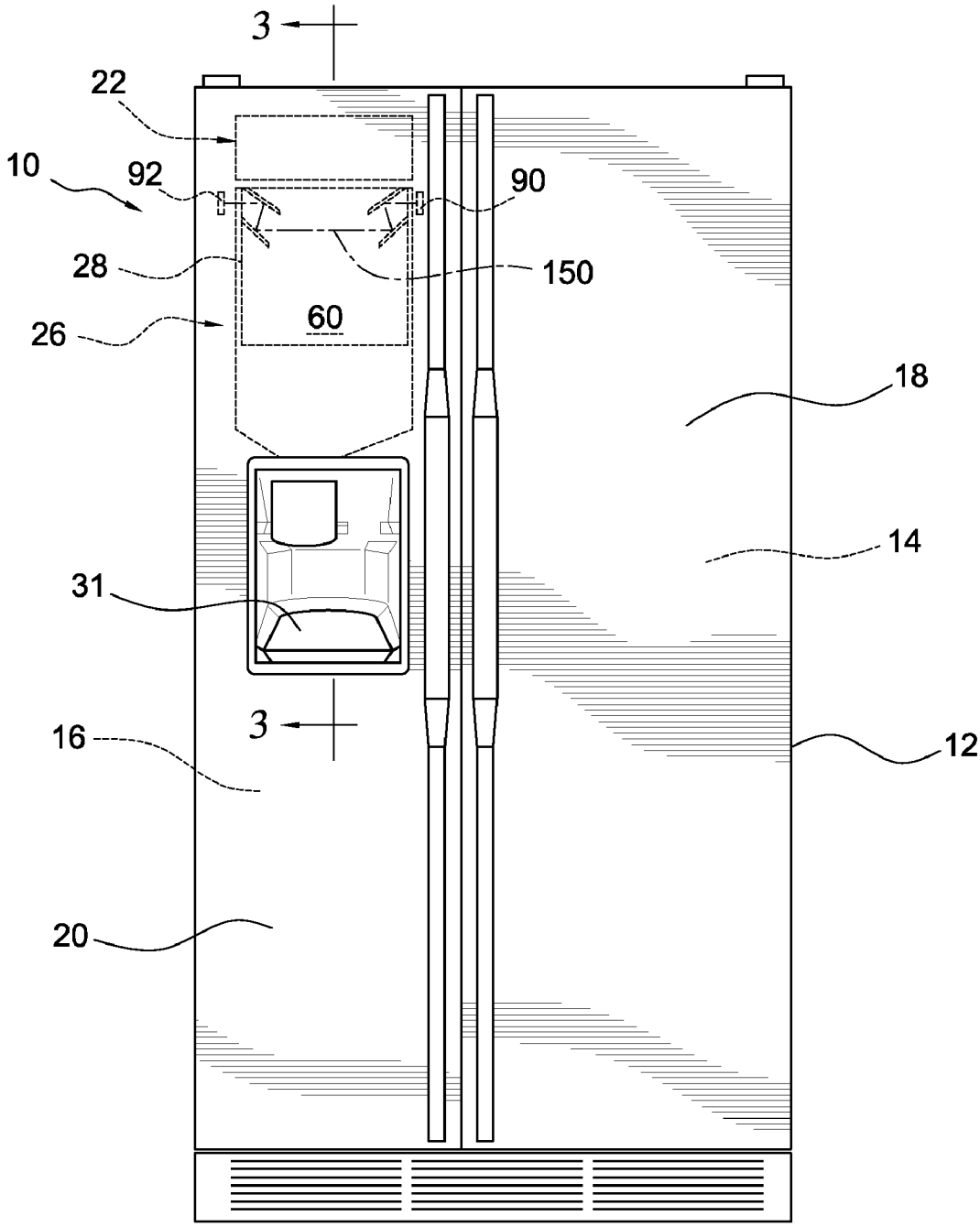
FIG. 1 is a front elevational view of a refrigerator apparatus incorporating an ice dispensing system with a variable ice storage assembly constructed in accordance with the present invention.
Figure 2:
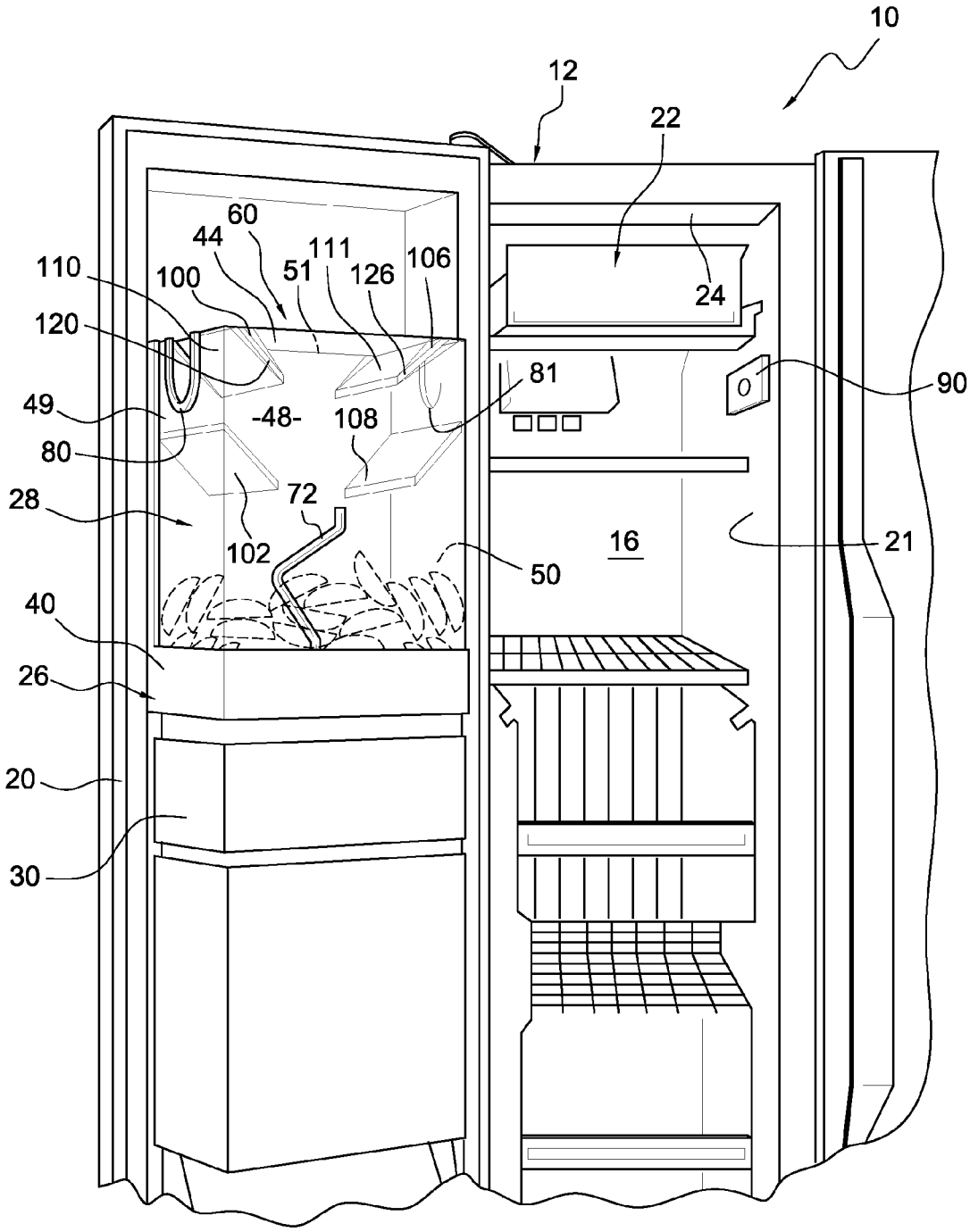
FIG. 2 is a partial perspective view of the freezer compartment inside the refrigerator of FIG. 1, including the ice dispensing system with a variable ice storage assembly.

With initial reference to FIGS. 1 and 2, a refrigerator 10, comprising a side-by-side fresh food/freezer configuration, includes a cabinet 12 forming a fresh food compartment 14 and a freezer compartment 16. Both the fresh food compartment 14 and the freezer compartment 16 are provided with access openings. A fresh food door 18 and a freezer door 20 are hingedly mounted to the cabinet 12 for closing the access openings in a manner well known in the art.

Figure 3:
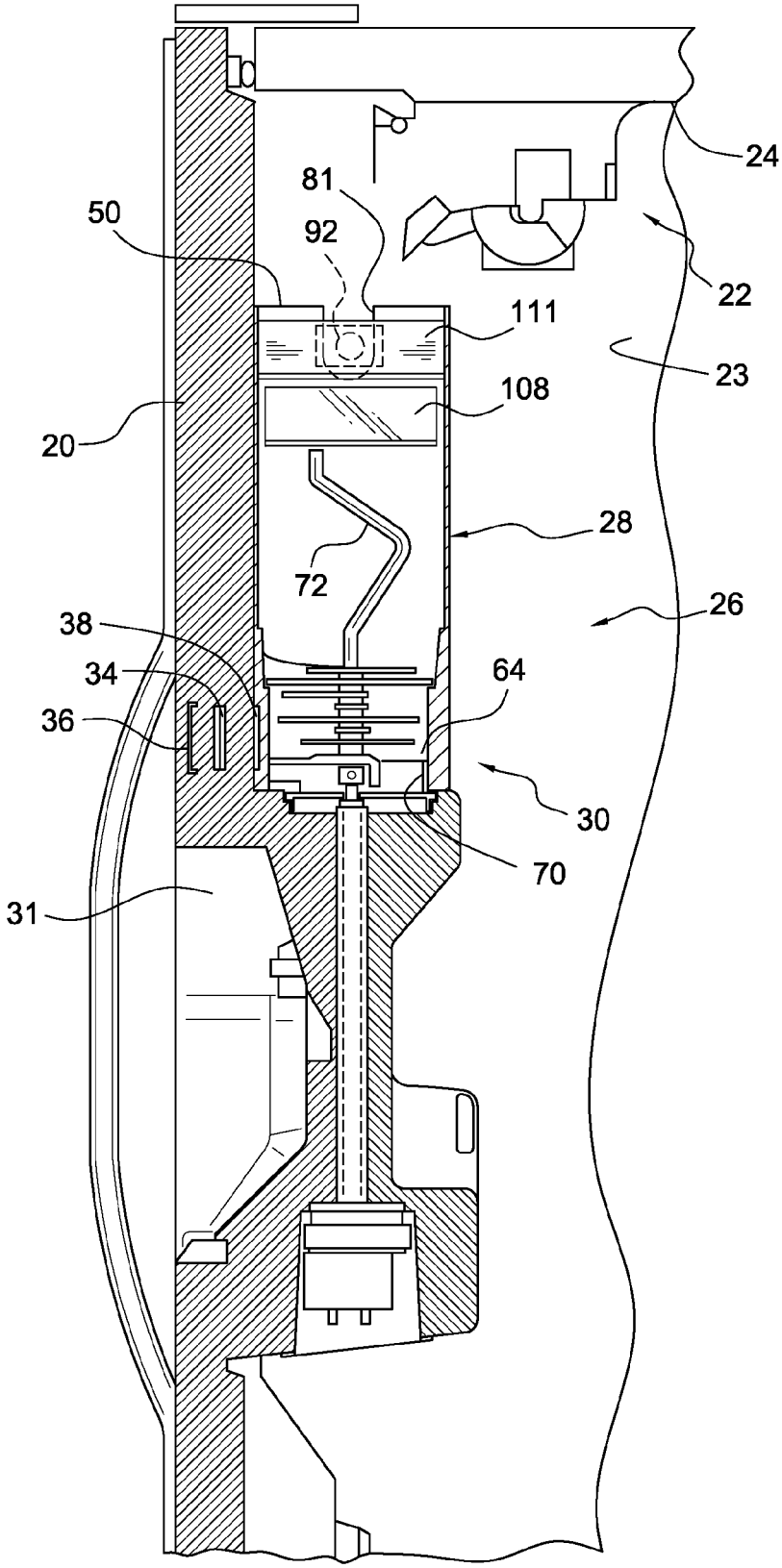
FIG. 3 is a left side view of the ice dispensing system and variable ice storage assembly of FIG. 2.

An ice making assembly 22 is disposed within the freezer compartment 16, such as being mounted to the inside surface of a top wall 24 of the freezer compartment 16 as shown. Regardless, at this point, is should be recognized that ice making assembly 22 can be mounted at a wide range of locations in freezer compartment 16. Preferably, ice maker assembly 22 is a conventional ice making apparatus which forms crescent shaped ice pieces as depicted in FIG. 3. The ice makers disclosed in U.S. Pat. Nos. 4,649,717 and 5,160,094, herein incorporated by reference, are illustrative of the type of ice maker used in the present invention.

An ice dispensing system 26, mounted to the freezer door 20, is provided below the ice making assembly 22 for receiving ice pieces. The ice dispensing system 26 includes a variable ice storage assembly 28. In the first embodiment shown in FIGS. 1-3, storage assembly 28 is in the form of an ice storage bin 29 including an ice crushing system 30. When operated, the ice dispensing system 26 transfers ice pieces from the storage assembly 28 through the freezer door 20, whereby ice pieces may be dispensed through a conventional, forwardly exposed ice dispenser station or service area 31. One of the benefits of such a system is that storage assembly 28 is removable from the freezer door. This allows a user to readily dispense a large quantity of ice from the storage assembly 28 into a receptacle, such as an insulated cooler.

The ice maker assembly 22 is designed to prevent ice harvesting when the storage assembly 28 is full of ice pieces, when the door 20 is open, or when ice storage bin 29 is removed from the door 20. The need for this function is well recognized in the ice maker art and a means for providing this function is described in detail in U.S. Pat. Nos. 4,649,717 and 5,160,094, which are incorporated herein by reference. Preferably, an inductive sensor is utilized in order to sense the presence of storage assembly 28 on door 20. In the embodiment shown in FIG. 3, a wire coil 34 is incorporated into door 20 of the refrigerator 10 and connected to inductance sensing circuitry indicated at 36. A ferrous metal plate 38 on or in storage assembly 28 causes a measurable change in inductance of wire coil 34 when metal plate 38 is proximal to wire coil 34. Alternatively, the ice bucket sensing apparatus may include a capacitive sensor rather than an inductive sensor. In another alternative arrangement, a reed switch and magnet sensing system (not shown) may be utilized. In this arrangement, the reed switch is preferably located within the refrigerator and either opened or closed by a magnet arranged on or in storage assembly 28. For instance, a magnet can be incorporated into base 40 of storage assembly 28 to actuate a reed switch located in freezer door 20. The status of the reed switch indicates the presence of storage assembly 28. At this point, it should be understood that the ice bucket sensor could be positioned in a variety of places within refrigerator 10 and should not be limited by the embodiments shown herein.

As best seen in FIG. 2, storage assembly 28 includes a base 40 and an upper body 44. The upper body 44 has a plurality of vertical walls which extend upwardly from the base member 40 and include a front wall 48, side walls 49 and 50, and a back wall 51. Together with the base member 40, the walls 48-50 define a storage cavity 60 for collecting ice pieces produced by ice maker assembly 22. The upper body 44 is preferably formed from a clear plastic material such that the quantity of ice pieces stored within the storage assembly 28 can be easily, visually determined, while the base 40 is preferably opaque to hide the dispensing mechanisms contained therein.

Storage assembly 28 may be utilized with an auger-type ice dispensing system, such as the one described in U.S. Pat. No. 6,425,259, also incorporated herein by reference. Turning to FIG. 3, storage assembly 28 includes a bottom wall portion 64 having an ice outlet opening 70 through which the ice pieces must pass to be dispensed. Rotatably supported within the storage assembly 28 is an auger 72. As is known in the art, rotation of auger 72 ensures that ice pieces are free to move downwardly, under the force of gravity, to the ice crushing system 30 such that ice pieces may be dispensed.

Additionally, storage assembly 28 may be utilized in conjunction with different ice-sensing systems, including the infrared sensing system described in U.S. Pat. No. 6,314,745 incorporated herein by reference. In general, light (electromagnetic radiation of any wavelength) is used to sense the presence of ice pieces. More specifically, an optical ice level sensing system takes advantage of the fact that ice pieces formed by a conventional ice maker, as described above, have a cloudy core which is due to air bubble entrapment caused during the freezing process, and water impurities among other things. This cloudy core of the ice pieces blocks a wide range of wave lengths that are generated and sensed by many standard infrared (IR) radiation products. In a preferred embodiment shown, storage assembly 28 includes apertures 80 and 81, which provide a clear line of sight between a light emitter 90 and a receiver 92 of an ice level sensor. Light emitter 90 is preferably mounted on side wall 21 of the freezer compartment 16 adjacent the top of the storage assembly 28, while the receiver 92 is mounted to a side wall 23 of the freezer compartment 16 opposite from the emitter 90. A microprocessor (not shown) controls the operation of the ice level sensing system.

Reference will now be made to FIGS. 2 and 3 in detailing certain inventive structure of storage assembly 28. In the first embodiment shown, storage assembly 28 includes a first insert portion 100 adjacent side wall 49 and a first stationary reflecting plate 102 extending from side wall 49 below aperture 80. Additionally, a second insert portion 106 is located adjacent side wall 50 and a second stationary reflecting plate 108 extends from side wall 50. First and second mirrored inserts 110 and 111 are adapted to be removably inserted into insert portions 100 and 106 respectively. Insert portions 100 and 106 include multiple angled slot pairs 120 and 126. More specifically, multiple sets of opposing slots 120 and 126 are formed along side walls 48 and 51 of storage assembly 28, and each set of opposing slots 120 and 126 is adapted to support a respective mirrored insert 110, 111 therein at a specific angle with respect to emitter 90 and first and second reflecting plates 102 and 108. It should be understood that stationary reflecting plates 102 and 108 are configured to reflect IR radiation when first and second mirrored inserts 110 and 111 are in any of the possible angled positions. Each angled position of mirrored inserts 110 and 111 allows for a different reflected height of IR radiation through storage cavity 60. Storage assembly 28 thus lowers the ice level sensed within storage cavity 60, thereby signaling ice maker 22 to stop ice production at a desired ice volume level. The preferred method of use will be discussed in more detail below with reference to the second embodiment of the present invention.

Figure 4A:
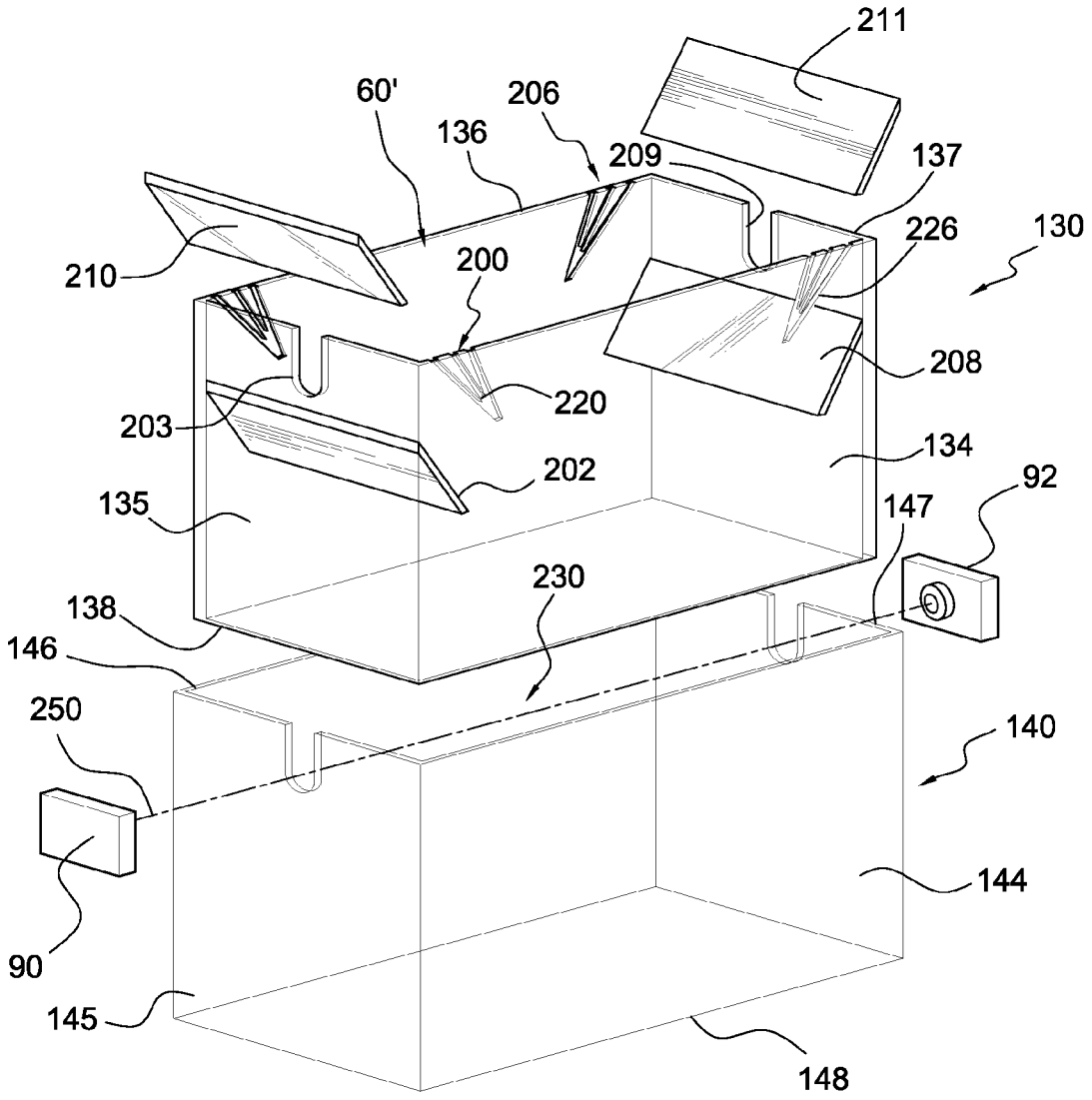
FIG. 4*a* is an exploded perspective view of an alternative embodiment of the variable ice storage assembly of the present invention.
Figure 4B:
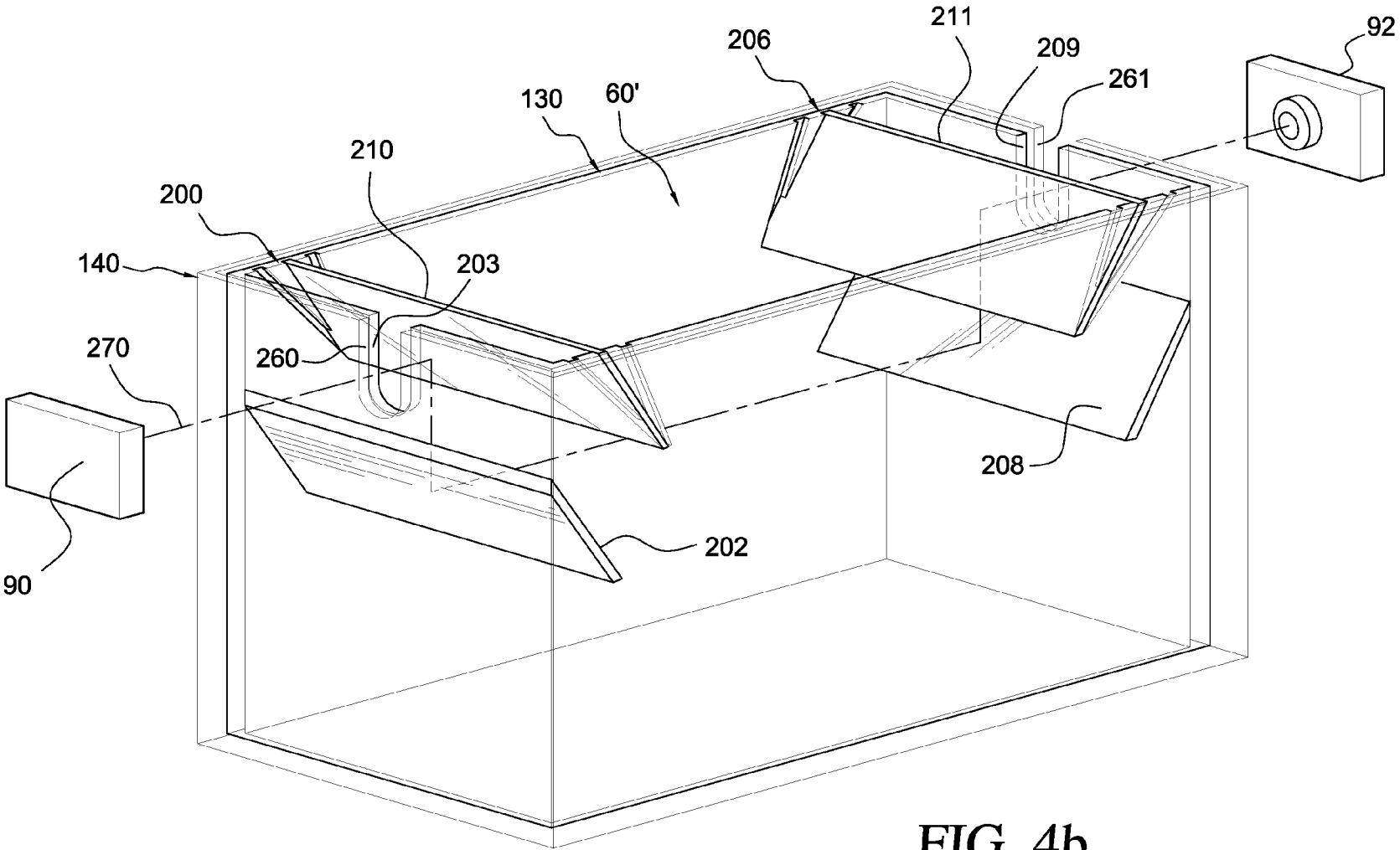
FIG. 4*b* is a perspective view of the variable ice storage assembly of FIG. 4*a* in a reflecting configuration.

Turning now to FIGS. 4*a* and 4*b*, an alternative variable ice storage assembly is shown, wherein variable ice storage assembly is in the form of a removable insert 130 including side walls 134-137, and optionally, a bottom wall 138. Insert 130 is adapted to be positioned within an ice bucket 140 including side walls 144-147 and a bottom wall 148. Additionally, removable insert 130 includes a first insert portion 200 adjacent side wall 135 and a first stationary reflecting plate 202 extending from side wall 135 below an aperture 203. Additionally, a second insert portion 206 is located adjacent side wall 137 and a second stationary reflecting plate 208 extends from side wall 137 below an aperture 209. First and second mirrored inserts 210 and 211 are adapted to be removably inserted into respective insert portions 200 and 206. Insert portions 200 and 206 include multiple angled slots 220 and 226, which allow first and second mirrored inserts 210 and 211 to be positioned at various angles within respective insert portions 200 and 206. It should be understood that stationary reflecting plates 202 and 208 are configured to reflect IR radiation when first and second mirrored inserts 210 and 211 are in any of the possible angled positions. Each angled position of mirrored inserts 210 and 211 allows for a different reflected height of IR radiation through a storage cavity 60' of insert 130.

When a user wishes to utilize removable insert 130, the user simply positions insert 130 within a storage cavity 230 of ice bucket 140. As depicted in FIG. 4*a*, storage cavity 230 is defined by side walls 144-147 and a bottom wall 148. In the non-reflecting configuration shown in FIG. 4*a*, IR radiation generated by light emitter 90 is directed along path 250 through storage cavity 230 to receiver 92. As discussed above, when ice pieces reach a certain volume within storage cavity 230, the ice pieces will impede the transmission of the IR radiation, signaling the ice making assembly 22 to stop ice production.

FIG. 4*b* depicts the storage assembly in a reflecting configuration, wherein mirrored inserts 210 and 211 are placed into respective insert portions 200 and 206. When insert 130 is positioned within storage cavity 230, apertures 260 and 261 of ice bucket 140 align with respective apertures 203 and 209 of insert 130. With this configuration, an IR beam originating from emitter 90 has a clear path to mirrored insert 210. In this configuration, IR radiation generated by light emitter 90 is directed along a circuitous path 270. More specifically, IR radiation reflects off mirrored insert 210 and is directed to stationary reflecting plate 202, where it is reflected across storage cavity 60' to stationary reflecting plate 208. In turn, stationary reflecting plate 208 reflects the IR radiation up to mirrored insert 211 where it is reflected toward light receiver 92. It should be understood that stationary reflecting plates 202 and 208 are configured to reflect IR radiation when mirrored inserts 210 and 211 are in any of the various, possible angled positions. Each angled position of mirrored inserts 210 and 211 allows for a different reflected height of IR radiation through storage cavity 60', thereby enabling a user to choose the optimal amount of ice stored in the storage assembly. In other words, this configuration essentially lowers the effective height of the sensor within storage cavity 60', thereby signaling ice maker 22 to stop ice production with a smaller volume of ice present in ice bucket 140 then when the system is in the non-reflecting configuration.

Although described with reference to preferred embodiments of the invention, it should be readily understood that various changes and/or modifications can be made to the invention without departing from the spirit thereof. For instance, although shown only in conjunction with the first embodiment of the present invention, it should be understood that the inductive sensing system discussed above may also be utilized with alternative embodiments of the present invention. In general, the invention is only intended to be limited by the scope of the following claims.

What is claimed is:

1. A refrigerator comprising:

a cabinet;

a freezer compartment arranged within the cabinet;

a door mounted to the cabinet for selectively providing access to the freezer compartment;

an ice maker disposed within the freezer compartment for forming ice pieces;

an ice level sensor comprising a light emitter and a receiver; and a removable variable ice storage assembly adapted to be positioned between the light emitter and the receiver, the removable variable ice storage assembly including:

a first side wall including a first reflecting plate;

a second side wall including a second reflecting plate;

first and second insert portions;

a storage cavity defined in part by said first and second side walls adapted to receive ice dispensed from the ice maker; and first and second mirrored inserts adapted to be removably supported by the respective first and second insert portions, wherein the first and second mirrored inserts are adapted to redirect a light beam emitted by the light emitter when the first and second mirrored inserts are supported by the respective first and second insert portions and the removable variable ice storage assembly is positioned between the light emitter and the receiver.

2. The refrigerator of claim 1, wherein the first insert portion comprises a first set of multiple angled slot pairs.

3. The refrigerator of claim 2, wherein the second insert portion comprises a second set of multiple angled slot pairs.

4. The refrigerator of claim 2, wherein each of the multiple angled slot pairs of the first insert portion has a different angle with respect to the emitter.

5. The refrigerator of claim 3, wherein each of the multiple angled slot pairs of the second insert portion has a different angle with respect to the emitter.

6. The refrigerator of claim 2, wherein the first set of multiple angled slot pairs are formed in third and fourth side walls of the insert.

7. The refrigerator of claim 3, wherein the second set of multiple angled slot pairs are formed in third and fourth side walls of the insert.

8. The refrigerator of claim 1, wherein the ice level sensor is an infrared sensor.

9. The refrigerator of claim 1, further comprising: an ice storage bin supported in the freezer compartment, wherein the variable ice storage assembly is adapted to be inserted into the ice storage bin.

10. The refrigerator of claim 9, further comprising: an inductive sensing assembly for sensing a presence of the ice storage bin.

11. The refrigerator of claim 10, wherein the inductive sensing assembly comprises a metal coil located on the refrigerator and a ferrous metal plate located on the ice storage bin.

12. The refrigerator of claim 1, wherein the variable ice storage assembly further comprises first and second apertures provided in the first and second side walls respectively, and wherein said first and second apertures align with the light emitter and receiver.

13. The refrigerator of claim 1, wherein the variable ice storage assembly further comprises a bottom wall.

14. A variable ice storage assembly adapted to receive ice dispensed from an ice maker comprising:

a first side wall including a first reflecting plate;

a second side wall including a second reflecting plate;

first and second insert portions; and first and second mirrored inserts adapted to be removably supported by respective first and second insert portions; wherein the first and second mirrored inserts are adapted to redirect a light beam emitted by a light emitter when the first and second mirrored inserts are supported by the respective first and second insert portions and the removable variable ice storage assembly is positioned between the light emitter and a receiver.

15. The variable ice storage assembly of claim 14, wherein the first insert portion comprises a first set of multiple angled slot pairs.

16. The variable ice storage assembly of claim 15, wherein the second insert portion comprises a second set of multiple angled slot pairs.

17. The variable ice storage assembly of claim 15, wherein each of the multiple angled slot pairs of the first insert portion has a different angle with respect to the first reflecting plate.

18. The variable ice storage assembly of claim 16, wherein each of the multiple angled slot pairs of the second insert portion has a different angle with respect to the second reflecting plate.

19. The variable ice storage assembly of claim 15, wherein the first set of multiple angled slot pairs are formed in third and fourth side walls of the insert.

20. The variable ice storage assembly of claim 16, wherein the second set of multiple angled slot pairs are located in third and fourth side walls of the insert.

21. The variable ice storage assembly of claim 14, wherein the variable ice storage assembly is adapted to be inserted into a refrigerator ice storage bin.

22. The variable ice storage assembly of claim 14, further comprising a first aperture in the first side wall and a second aperture in the second side wall.

23. The variable ice storage assembly of claim 14, further comprising a ferrous metal plate adapted to cooperate with a metal coil of an inductive ice level sensor.

24. The variable ice storage assembly of claim 14, further comprising a bottom wall interconnecting the first and second side walls.

25. A method for altering a level of ice sensed by an ice level sensor in a refrigerator comprising:

inserting a removable variable ice storage assembly into a freezer compartment of a refrigerator between a light emitter and a receiver of the ice level sensor, the removable variable ice storage assembly including a first side wall having a first reflecting plate, a second side wall having a second reflecting plate, a storage cavity, defined in part by the first and second side walls, adapted to receive ice dispensed from the ice maker, and first and second insert portions, wherein first and second insert portions include respective first and second sets of multiple angled slot pairs;

inserting a first mirrored insert into a select first angled slot pair of the first set of multiple angled slot pairs of the first insert portion, wherein the first angled slot pair is selected based on the level of ice desired in the ice bucket;

inserting a second mirrored insert into a select second angled slot pair of the second set of multiple angled slot pair of the second insert portion, wherein the second angled slot pair is selected based on the level of ice desired in the ice bucket; and directing light from the light emitter to the receiver, with the light hitting each of the first and second reflective plates and the first and second mirrored inserts.

* * * * *

UNITED STATES PATENT AND TRADEMARK OFFICE

CERTIFICATE OF CORRECTION

PATENT NO. : 8,109,112 B2
APPLICATION NO. : 12/036347
DATED : February 7, 2012
INVENTOR(S) : Lindsey A. Smith et al.

It is certified that error appears in the above-identified patent and that said Letters Patent is hereby corrected as shown below:

Col. 8, lines 4 - 29, Claim 25: "A method for altering a level of ice sensed by an ice level sensor in a refrigerator comprising: inserting a removable variable ice storage assembly into a freezer compartment of a refrigerator between a light emitter and a receiver of the ice level sensor, the removable variable ice storage assembly including a first side wall having a first reflecting plate, a second side wall having a second reflecting plate, a storage cavity, defined in part by the first and second side walls, adapted to receive ice dispensed from the ice maker, and first and second insert portions, wherein first and second insert portions include respective first and second sets of multiple angled slot pairs; inserting a first mirrored insert into a select first angled slot pair of the first set of multiple angled slot pairs of the first insert portion, wherein the first angled slot pair is selected based on the level of ice desired in the ice bucket; inserting a second mirrored insert into a select second angled slot pair of the second set of multiple angled slot pair of the second insert portion, wherein the second angled slot pair is selected based on the level of ice desired in the ice bucket; and directing light from the light emitter to the receiver, with the light hitting each of the first and second reflective plates and the first and second mirrored inserts." should be Claim 25: -- A method for altering a level of ice sensed by an ice level sensor in a refrigerator comprising:

inserting a removable variable ice storage assembly into a freezer compartment of a refrigerator between a light emitter and a receiver of the ice level sensor, the removable variable ice storage assembly including a first side wall having a first reflecting plate, a second side wall having a second reflecting plate, a storage cavity, defined in part by the first and second side walls, adapted to receive ice dispensed from an ice maker, and first and second insert portions, wherein first and second insert portions include respective first and second sets of multiple angled slot pairs; inserting a first mirrored insert into a select first angled slot pair of the first set of multiple angled slot pairs of the first insert portion, wherein the first angled slot pair is selected based on the level of ice desired in an ice bucket; inserting a second mirrored insert into a select second angled slot pair of the second set of multiple angled slot pair of the second insert portion, wherein the second angled slot pair is selected based on the level of ice desired in the ice bucket; and directing light from the light emitter to the receiver, with the light hitting each of the first and second reflective plates and the first and second mirrored inserts. --

Signed and Sealed this
Sixteenth Day of October, 2012

David J. Kappos

David J. Kappos
*Director of the United States Patent and Trademark Office*